United States Patent [19]

Hinckley et al.

[11] Patent Number: 4,921,677

[45] Date of Patent: May 1, 1990

[54] SLIDING VALVE FOR VENT OF LIQUID COLLECTING COMPARTMENT

[75] Inventors: Charles C. Hinckley, Pittsford; Lewis T. Del Plato, Jr., Rochester, both of N.Y.

[73] Assignee: Eastman Kodak Company, Rochester, N.Y.

[21] Appl. No.: 240,179

[22] Filed: Sep. 6, 1988

Related U.S. Application Data

[63] Continuation-in-part of Ser. No. 98,248, Sep. 18, 1987.

[51] Int. Cl.[5] ..... B01L 11/00

[52] U.S. Cl. ..... 422/103; 422/101; 422/61; 435/295; 435/300; 137/544; 137/575; 251/145

[58] Field of Search ..... 422/103, 101, 61; 435/295, 300; 137/544, 575, 597; 251/145; 73/863

[56] References Cited

U.S. PATENT DOCUMENTS 4,833,087 5/1989 Hinckley ..... 422/61
4,847,199 7/1989 Snyder et al. ..... 435/36

*Primary Examiner*—Christine M. Nucker
*Assistant Examiner*—Janelle D. Waack
*Attorney, Agent, or Firm*—Dana M. Schmidt

[57] ABSTRACT

There is disclosed a liquid-collecting compartment that is vented to allow air to escape. The compartment is improved in that a closure member is provided constructed so as to be slidable onto and off of the vent aperture with a force that is between about 0.15 newtons and about 20 newtons. To achieve this, an elastomeric member is provided in the closure member or the wall at the aperture, with selected properties of durometer, cold flow and static coefficient of friction against polystyrene.

16 Claims, 2 Drawing Sheets

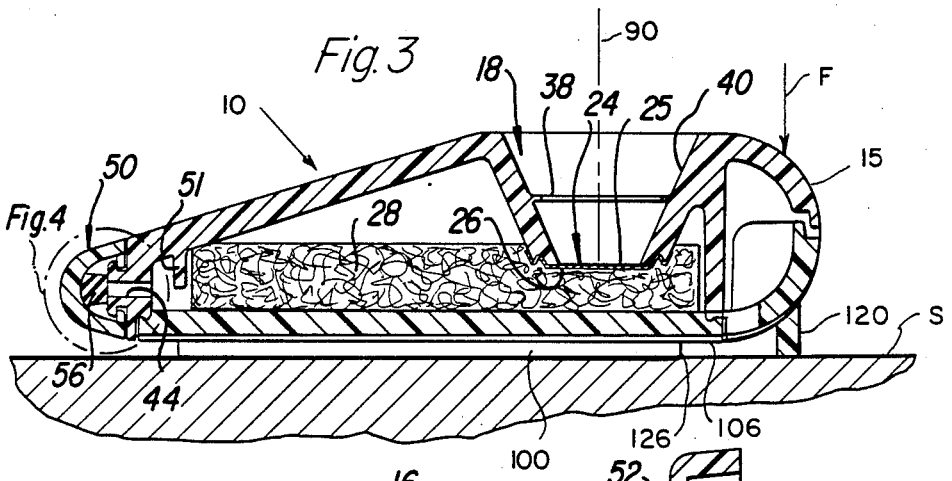
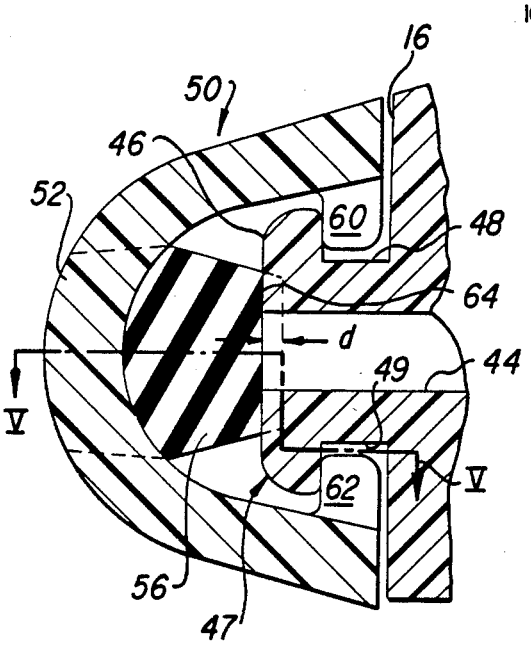
Fig. 4
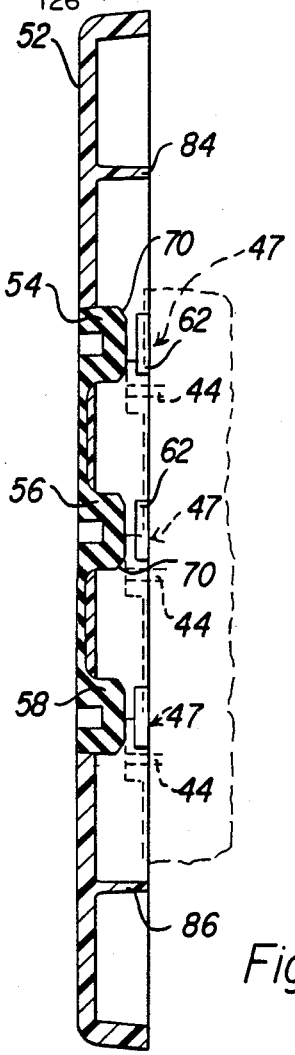
Fig. 5

SLIDING VALVE FOR VENT OF LIQUID COLLECTING COMPARTMENT

RELATED APPLICATIONS

This is a continuation-in-part application of U.S. Ser. No. 098,248 filed on Sept. 18, 1987.

FIELD OF INVENTION

This invention relates to a construction used to open and close vents in a liquid-collecting compartment, particularly such compartments used in assay devices.

BACKGROUND OF THE INVENTION

In the analysis for infectious diseases or pregnancy conditions, it is common to do an immunoassay in a device having an upper compartment, a lower compartment paired with the upper one and containing a liquid-absorbing material, and a filter between them. Examples are shown in U.S. Pat. No. 3,888,629. In such devices, a trio of such paired compartments, side-by-side, allows the patient sample to be tested in one, a positive control in another, and a negative control in a third.

In such devices, a vent hole is commonly provided in each of the lower compartments, to allow air to escape as liquid is entering. By appropriately opening and closing such vent holes, an air lock can be created which will allow, or stop, respectively, liquid flow into the lower compartment from above. (Air cannot pass out through the filter either, once it is wetted.) The stoppage of flow is appropriate to allow the liquid to incubate first at the filter, before passing down into the lower compartment, as is well-known.

Prior to this invention, there has been no convenient method for manually operating the opening and closing of each of the vents. The opening and closing of each vent separately has not been conducive to easy use of such devices. Particularly this has been troublesome where the devices are sold for home use, such as in home pregnancy kits. Additionally, it is necessary, particularly in the home kits, that the vent closure be operable manually. Materials that give negligible resistance to hand movement also tend to not reliably seal off the vent. Conversely, those that provide a secure seal tend to give high resistance to a manual opening of the vent. Furthermore, if tolerances are allowed to vary, it is difficult to provide a seal that covers both the varying tolerances and stays within a desired sliding force range. Such problems are magnified if all three compartments are vented at once.

SUMMARY OF THE INVENTION

I have constructed a device useful in the immunoassay of infectious diseases or pregnancy conditions, which overcomes the aforementioned problems, particularly by providing a sliding valve that is operable manually.

More specifically, in accord with one aspect of the invention, there is provided a liquid-collecting device comprising at least one liquid-collecting compartment, means in that one compartment defining a vent aperture fluidly connecting the compartment to the atmosphere, and closure means for shutting off the vent aperture, the aperture-defining means including a portion of a wall in which the aperture is located. The device is improved in that (a) the closure means comprise a slide valve, (b) one of the slide valves and the wall portion comprises an elastomeric member, and (c) there is included means for slidably mounting the slide valve and the wall portion relative to each other to move the slide valve between a first position covering the aperture and a second position which uncovers the aperture, the member being formed of an elastomer having a durometer, cold flow and a static coefficient of friction with respect to the other of the slide valve and wall portion, that are effective to allow the slide valve to be slid between the positions, when a relative compression is provided between the member and the wall of about 0.15 mm, with a sliding force that is between about 0.15 newtons and about 20 newtons, whereby the slide valve is readily manually movable on the device.

In accord with another aspect of the invention, there is provided a liquid collecting device comprising three separate but adjacent liquid-collecting compartments, means in each of the compartments defining a vent aperture fluidly connecting each compartment to the atmosphere, and closure means for each of the compartments for shutting off the the respective aperture, the aperture-defining means including a portion of a wall in which the aperture is located. The device is improved in that each of the three closure means comprises a slide valve comprising an elastomeric member and means for slidably mounting the member over the aperture to move between a first position covering the aperture and a second position in which the member uncovers the aperture, the member being formed of an elastomer having a durometer, cold flow and a static coefficient of friction with respect to the wall portion that are effective to allow the slide valve to be slid between the positions, when the member is compressed by the wall by about 0.15 mm, with a sliding force that is between about 0.15 newtons and about 20 newtons, whereby each slide valve is manually movable on said device.

In accord with yet another aspect of the invention, there is provided a test device useful for conducting a reaction with a patient's biological liquid, the device including a housing having at least one test well therein, shaped to hold and confine temporarily a portion of biological liquid, and a filter at the bottom of the well for separating and retaining particulate material that is the product of the reaction, from free liquid that passes through the filter, the housing further including (a) supporting means underneath the filter for supporting the device on a fixed surface, and (b) a gripping edge along the housing to allow a user to hold the device, the gripping edge including a surface against which force is applied by a user while gripping the device, the force including a downward vertical component. The device is improved in that the supporting means of the housing includes a member underneath the filter, positioned at a location generally opposite to the gripping edge, the member being constructed to react against the downward vertical force component and prevent the device from being tipped.

Thus, it is an advantageous feature of the invention that a device useful in immunoassays is provided with a valve for closing the necessary vent, that is manually operable with a minimum of effort, and still allows tolerance variability.

It is a further advantageous feature of the invention that such a device is provided with a plurality of liquid-collecting compartments, each independently vented, and a slide valve that opens and closes each vent simultaneously, with a minimum of effort.

Other advantageous features will become apparent upon reference to the following Detailed Discussion, when read in light of the attached drawings.

BRIEF DESCRIPTION OF THE DRAWINGS

FIG. 3 is a section view taken along line III—III of FIG. 2;

FIG. 4 is an enlarged section view of the portion of FIG. 3 encircled as "IV"; and FIG. 5 is a section view taken generally along line V—V of FIG. 4, of only the slide valve 50.

DESCRIPTION OF THE PREFERRED EMBODIMENTS

The invention is described herein in the context of the preferred embodiments, in which the device has three pairs of upper/lower compartments, to assay (a) the patient sample, (b) a positive control and (c) a negative control, all more or less simultaneously. In addition, aspects of the invention are useful with only a single pair of compartments, and even without the upper compartment if one simply desires control over the rate of flow into a liquid-receiving compartment.

The actual chemistries of the assay are not described in detail, primarily because the mechanics of the device are applicable to any, or even no, chemistry, provided it is appropriate that flow not take place instantaneously into the liquid-receiving compartment. If the flow should proceed instantaneously, there is no need to have a valve to close the vents, as provided for by this invention.

In the most preferred embodiment, the chemistries provide for an immunoassay, in which there is separately received at three filters in three compartments, a patient antigen complexed with an antigen, a positive control for the complex so formed, and a negative control for the complex so formed, respectively.

Figure 1:
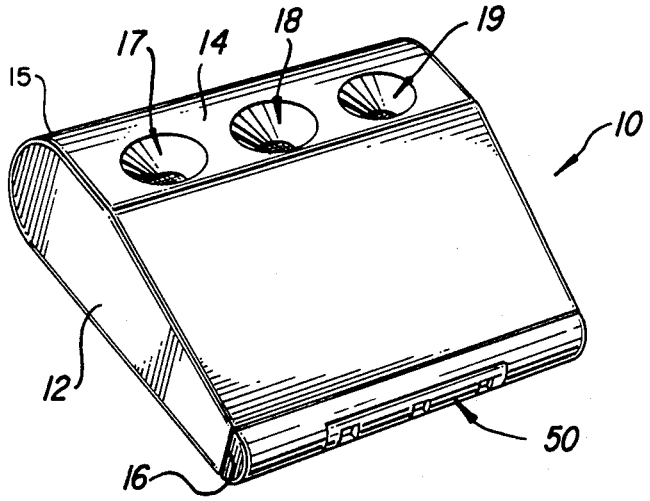
FIG. 1 is a perspective view of a device constructed in accord with the invention.

A device 10 constructed in accord with at least one aspect of the invention comprises, Figure 1, a frame or housing 12 having a top surface 14, a front edge 16, and a rear edge 15. Mounted on edge 16 is a slide valve 50 in accord with the invention. Top surface 14 has three wells or upper compartments 17, 18 and 19. Each well has an axis 90 that is generally an axis of symmetry (FIG. 3). In use, axis 90 extends generally vertically, to keep patient sample liquid confined in well 18. At the bottom of each of the compartments is a filter 24, FIG. 2 and 3, of appropriate pore size and pore volume. Filters 24 have an upper surface 25 and an under surface 26, FIG. 3. Surface 26 is in liquid-flow contact with an absorbent material 28 that preferably occupies each of three lower compartments 30, 32 and 34, FIG. 2, paired with the upper ones. As used herein, "liquid-flow contact" means, in sufficient proximity such that a liquid meniscus emanating from surface 26 will also wet material 28 and flow into it, if no air lock exists in the lower compartment. Material 28 is any bibulous material, having a sufficient pore volume to soak up about 2 cc of liquid. Useful materials include cellulose acetate, cotton, and rayon. Useful materials for filters 24 include polyamides, such as nylons, and for example nylon-66 microporous membranes manufactured under the tradenames BIODYNE A or ULTIPOR N-66 by Pall Corporation. Most preferably, the membranes are precoated (prior to use) with one or more water-soluble proteins, such as casein derivatives obtained from acylation, alkylation or sulfonylation of the casein.

Optionally the device can contain (between the filter and the absorbent material) a porous member which restricts flow back up to the filter, but allows flow from the filter to the absorbent material.

Various optional treatments can be given the filter's upper surface 25, depending on the assays to be used. One such treatment is spelled out in commonly owned, co-filed U.S. Application Ser. No. 098249 entitled "Filter and Test Device Containing Same, with Flow-Delaying Polymer", filed by Roger Nelson. Specifically, the filter is treated with a water-soluble polymeric overcoat selected to provide an induction time of from about 30 to about 300 seconds of delay, for a liquid head of pressure of about 6 mm of water. This treatment allows aqueous-based reagents to be coated thereafter onto the filter, and dried in less than 30 seconds, without having the reagents pass through the filter. Useful examples of such polymers include polyvinyl alcohol, polyvinyl pyrrolidone, caboxymethyl cellulose, and carboxyethyl cellulose.

To provide support for the device as it rests on a horizontal surface S, legs 100 are provided extending from undersurface 106 of frame 12. Legs 100 extend depthwise, as shown, for a majority of the depth.

Figure 2:
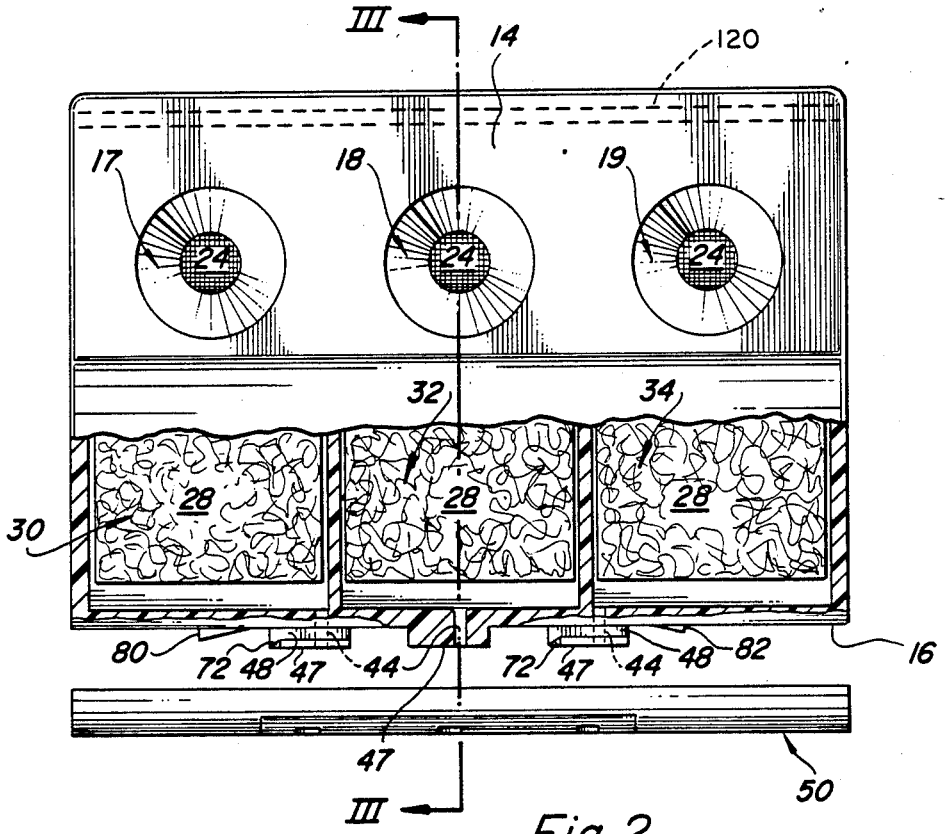
FIG. 2 is a plan view, partially broken away, and with the slide valve exploded away, of the device.

In accord with one aspect of the invention, a preferred aspect, to prevent device 10 from being inadvertently tipped during use by an operator's downwardly-directed force F applied while gripping edge 15, a lengthwise-extending leg 120 is also provided on the undersurface 106 FIGS. 2 and 3. Leg 120 should extend at least a portion of the length of device 10, and be located generally opposite to the downward force F. (As used herein, "generally opposite" means, as far outboard as is necessary to counteract any moment arm created by force F about pivot edge 126 noted below.) In this fashion, device 10 is prevented from inadvertently pivoting about edge 126 of legs 100, because leg 120 is located the same general distance from pivot edge 126, as the length of the moment arm created by force F. Alternatively, not shown, legs 100 can be extended all the way rearwardly to the location of leg 120, thus obviating the need for a lengthwise-extending leg 120. In this aspect of the invention, the presence of an absorbent material 28 under filter 24 is not considered essential, as other means can be used to withdraw liquid through the filter, for example, a conduit connected to a vacuum source, not shown.

Alternatively, if care is exercised by the user regarding the potential force F being applied, leg 120 can be omitted entirely and legs 100 can extend only the distance actually shown, FIG. 3.

Optionally, a liquid level indicator ridge 38, FIG. 3, is provided in the wall 40 of each well, as a circular ring. Alternatively, such an indicator can be one or two fragments of a ring vertically spaced on wall 40, or a vertical bar or a raised dot (not shown).

Vent aperture 44 is provided in each compartment 30, 32 and 34, FIGS. 2 and 3, to allow air passage out of the compartment as liquid flows in. Without such vents, or when the vent apertures are closed, an air lock precludes liquid from flowing through filter 24 into the lower compartments. The vent apertures extend to a wall surface 46, FIGS. 3 and 4, each of which comprises the end face of a stud 47 extending from edge 16. Stud 47 is grooved at 48 and 49, FIG. 4, to slidably accommodate mating lips from valve 50, as will be apparent. There are three studs 47, one for each aperture, FIG. 2.

To insure that absorbent material 28 does not come in contact with aperture 47, and thus leak liquid, stops 51 are pendent from frame 12, FIG. 3, in a position interposed between material 28 and aperture 44.

In accord with the invention, slide valve 50 is provided to alternately open and close vent apertures 44. Valve 50 comprises mounting member 52, and three valve seats 54, 56 and 58 that correspond to each of studs 47. Lips 60, 62 are provided at the side edges of member 52, to ride in grooves 48 and 49, respectively, and to force studs 47 against the valve seats.

In either the valve seats or the contacting wall surface 46, there is an elastomeric material, and in the other contacting member there is a relatively rigid material such as polystyrene. The elastomeric member is preferably in the valve seats and is especially selected for durometer hardness, cold flow, and coefficient of friction that will ensure that, when the valve seats are to be slid to the side of studs 47, having been compressed by the studs an amount of about 0.15 mm, they can be slid with a force that is between about 0.15 newtons and about 20 newtons. (Anything less than about 0.15 newtons will cause member 52 to slide uncontrollably under its own weight. A force in excess of 20 newtons has been found to be too high for easy manual manipulation.) A preferred value is about 17.5 newtons.

The above test is not intended to imply that seats 54–58 are only to be compressed 0.15 mm when member 52 is mounted on studs 47. Instead, the compression can be distance "d", FIG. 4, which can be from about 0 to as much as 0.3 mm, measured at surface 64 of the seat shown in phantom for its uncompressed position. Practically speaking, however, some compression is preferred to ensure that surface 60 of seats 54–58 is in fact sealed over aperture 44. For the measurement of the force required to slide the valve, 0.15 mm compression is preferred.

To achieve the sliding force of from 0.15 to about 20 newtons, the noted properties for the elastomeric material are preferably within the following ranges: Durometer (a measure of hardness) of no greater than about 70 Shore A, and most preferably from 55 to 65 Shore A. Cold flow (a measure of loss of recovery after being deformed, also known as "compression set") of between about 10 and about 40% lost recovery when compressed at 25° C., and most preferably, 23% lost recovery. Coefficient of friction (static) against polystyrene (the preferred material for stud 47) of between about 0.3 and about 0.6, and most preferably about 0.35.

Useful materials falling within these ranges include thermoplastic rubber available under the tradename Santoprene Neutral 201-55 and 201-64, from Monsanto Corp. These two rubbers have the following specific properties:

| | Neutral 201-55 | 201-64 |
|---|---|---|
| Hardness | 55 Shore A | 64 Shore A |
| Spec. Gravity | 0.97 | 0.97 |
| Tensile Strength | 47 Kg/cm$^2$ | 70 Kg/cm$^2$ |
| Ultimate Elongation | 330% | 400% |
| 100% Modulus | 21 Kg/cm$^2$ | 25 Kg/cm$^2$ |
| Tear Strength (25° C.) | 19 kN/m | 24.5 kN/m |
| Tension Set | 6% | 10% |
| Cold Flow at 25° C. | 23% | 23% |
| Flex Fatigue (cycles to fail) | >3.4 million | >3.4 million |
| Brittle Point | Not Available | <60° C. |
| Static Coefficient of Friction (against polystyrene) | 0.59 | 0.35 |

Optionally, seats 54, 56 and 58 are each chamfered at 70, FIG. 5, to aid in sliding the seats onto studs 47. Additionally, studs 47 are optionally chamfered at 72, FIG. 2, to aid in assembling slide valve 50 onto the studs during manufacturing.

To assist in keeping slide valve 50 from being slid too far in either direction, stops 80 and 82 are preferably provided at edge 16. These stops cooperate with surfaces 84 and 86 on mounting member 52, FIG. 5.

In use, slide valve 50 is first kept in place with seats 54, 56 and 58 sealed over apertures 44, the position shown in FIGS. 1–4. This position prevents liquid from entering compartments 30, 32 and 34 because of the air lock. (Each lower compartment is fluidly isolated from the others.) To uncover apertures 44, member 52 is slid to the left, FIGS. 1 and 2, to the position shown on studs 47 in phantom, FIG. 5. As is readily apparent, apertures 44 are uncovered simultaneously in this position, so that air can flow out. At the same time, any liquid on filter 24 flows into the lower compartment.

Filters 24 act as follows, in the preferred embodiment: In compartment 18, the patient sample's antigens, if any, complex with antibodies coated on wall 40 or added by the user, some of which are labeled, so that the complex is unable to pass through the filter. If no antigen is present, all the labeled antibodies pass through and are not available for detection. In compartment 19, antigen is supplied on the filter or on upper chamber wall 40 as manufactured, and when antibody is added by the filter, a complex forms as a positive control, and remains on the filter for detection. In compartment 17, no complexing will occur unless the test conditions are improper, such as due to the presence of high amounts of salt, in which case a special anti-complexing agent such as N-acetylglucosamine is overcome and complexing forms for detection as a negative control.

One example of an assay that can be conducted in this fashion is an assay for hCG, to detect pregnancy. The patient sample in such a case is urine, but generally any biological liquid can be assayed by this device.

Device 10 is not a large device, having a length for valve 50, FIG. 2, and thus for the entire device, of no more thann about 6.5 cm. Thus, with the properties of the valve seats 54, 56 and 58 described above, it is readily feasible to slide slide valve 50 back and forth manually, by using finger pressure.

Alternatively (not shown), the elastomeric member can comprise at least the surface portion 46 of stud 47, FIG. 4, with the member 56 being formed of a relatively rigid material, for example, polystyrene. In that case it is the surface portion 46 that is preferably compressed distance "d" when the slide valve is on the studs.

The invention has been described in detail with particular reference to preferred embodiments thereof, but it will be understood that variations and modifications can be effected within the spirit and scope of the invention.

What is claimed is:

1. In a liquid-collecting device comprising at least one liquid-collecting compartment, means in said at least one compartment defining a vent aperture fluidly connecting said compartment to the atmosphere, said aperture-defining means including a portion of a wall in which said aperture is located, and closure means for shutting off said vent aperture;

the improvement wherein (a) said closure means comprise a slide valve, (b) one of said slide valve and said wall portion comprises an elastomeric member, and (c) further comprising means for slidably mounting said slide valve and said wall portion relative to each other to move said slide valve between a first position covering said aperture and a second position which uncovers said aperture, said member being formed of an elastomer having a durometer, cold flow and a static coefficient of friction with respect to the other of said slide valve and said wall portion, that are effective to allow said slide valve to be slid between said positions, when a relative compression is provided between said member and said wall of about 0.15 mm, with a sliding force that is between about 0.15 newtons and about 20 newtons, whereby the slide valve is readily manually movable on said device.

2. A device as defined in claim 1, wherein said elastomeric member is in said slide valve.

3. A device as defined in claim 2, and further comprising at least one additional liquid collecting compartment, means in said at least one additional compartment comprising a vent aperture fluidly connecting said compartment to the atmosphere, said aperture-defining means including a portion of a wall in which said aperture is located, and closure means for shutting off said vent aperture; said closure means of said additional compartment comprising a slide valve substantially identical to said slide valve of said at least one compartment.

4. A device as defined in claim 3, wherein said slide valves comprise a single integral member in which said valves are disposed so as to simultaneously cover and uncover said apertures as said member is slid between said first and second positions, respectively.

5. A device as defined in claim 1, wherein said elastomeric member has a hardness that is no greater than about 70 Shore A.

6. A device as defined in claim 1, wherein said elastomeric member has a cold flow that is between about 10 and about 40% loss of recovery when compressed at 25° C.

7. A device as defined in claim 1, wherein said coefficient of friction is between about 0.3 and about 0.6.

8. A device as defined in claim 1, and further comprising a water-absorbing material in said compartment.

9. In a liquid collecting device comprising three separate but adjacent liquid-collecting compartments, means in each of said compartments defining a vent aperture fluidly connecting said each compartment to the atmosphere, said aperture-defining means including a portion of a wall in which said aperture is located, and closure means for each of said compartments for shutting off said respective apertures;

the improvement wherein each of said three closure means comprise a slide valve comprising an elastomeric member and means for slidably mounting said member over said aperture to move between a first position covering said aperture and a second position in which said member uncovers said aperture, said member being formed of an elastomer having a durometer, cold flow and a static coefficient of friction with respect to said wall portion that are effective to allow said slide valve to be slid between said positions, when said member is compressed by said wall by about 0.15 mm, with a sliding force that is between about 0.15 newtons and about 20 newtons, whereby each slide valve is manually movable on said device.

10. A device as defined in claim 9, and further including filtering means for each of said compartments, constructed to receive on said filtering means, each at one of the respective compartments, a patient antigen complexed with an antibody, and positive and negative controls for the complex formed by the patient antigen;

whereby said device is useful in an immunoassay.

11. A device as defined in claim 9, wherein said elastomeric member has a hardness that is no greater than about 70 Shore A.

12. A device as defined in claim 9, wherein said elastomeric member has a cold flow that is between about 10 and about 40% loss of recovery when compressed at 25° C.

13. A device as defined in claim 9, wherein said coefficient of friction is between about 0.3 and about 0.6.

14. A device as defined in claim 9, wherein said three slide valves comprise an integral member, said valves being disposed on said member to cover and uncover, simultaneously, said apertures as said integral member is moved between said first and second positions.

15. A device as defined in claim 9, and further comprising a water-absorbing material in said compartment.

16. A device as defined in claim 15, and further comprising a filter disposed upstream of, and in liquid-flow contact with, said water-absorbing material.

* * * * *